US010289036B2

(12) United States Patent
Yokoyama et al.

(10) Patent No.: US 10,289,036 B2
(45) Date of Patent: May 14, 2019

(54) IMAGE FORMING APPARATUS

(71) Applicant: CANON KABUSHIKI KAISHA, Tokyo (JP)

(72) Inventors: Ken Yokoyama, Mishima (JP); Hiroyuki Kadowaki, Boise, ID (US); Kuniaki Kasuga, Mishima (JP); Shuichi Tetsuno, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/910,464

(22) Filed: Mar. 2, 2018

(65) Prior Publication Data

US 2018/0253036 A1 Sep. 6, 2018

(30) Foreign Application Priority Data

Mar. 6, 2017 (JP) ..... 2017-041699
Dec. 26, 2017 (JP) ..... 2017-249817

(51) Int. Cl.
*G03G 15/16* (2006.01)
*G03G 15/00* (2006.01)

(52) U.S. Cl.
CPC ..... *G03G 15/167* (2013.01); *G03G 15/1615* (2013.01); *G03G 15/5008* (2013.01); *G03G 15/75* (2013.01); *G03G 2215/00075* (2013.01)

(58) Field of Classification Search
CPC ..... G03G 15/1665–15/167; G03G 2215/1623; G03G 2215/00075
See application file for complete search history.

(56) References Cited

U.S. PATENT DOCUMENTS 9,395,657 B2 7/2016 Okumura

FOREIGN PATENT DOCUMENTS

JP 2016-001268 A 1/2016

*Primary Examiner* — Erika J Villaluna
(74) *Attorney, Agent, or Firm* — Venable LLP

(57) ABSTRACT

In an image forming apparatus, a peripheral velocity difference is provided between a peripheral velocity of an intermediate transfer belt and a peripheral velocity of an image bearing member, and when a relative moving distance between the image bearing member and the intermediate transfer belt, which is generated in the transfer nip portion because of the peripheral velocity difference, is taken as a shift amount of the toner image, a lower limit value of the shift amount is set to be at least ⅜, preferably half of an average perimeter calculated from a weight-average particle diameter of the toner, which is measured in advance.

13 Claims, 12 Drawing Sheets

IMAGE FORMING APPARATUS

BACKGROUND OF THE INVENTION

Field of the Invention

The present invention relates to an image forming apparatus, such as a copier and a printer, which forms images by an electrophotographic system, and more particularly to an image forming apparatus which includes an intermediate transfer belt for primarily transferring a toner image from an image bearing member.

Description of the Related Art

An example of this type of image forming apparatus that has been known is disclosed in Japanese Patent Application Publication No. 2016-1268. The image forming apparatus according to Japanese Patent Application Publication No. 2016-1268 includes: an image bearing member; an intermediate transfer belt onto which a toner image, formed on the image bearing member, is transferred; and a primary transfer roller which is disposed so as to contact the surface of the intermediate transfer belt on the opposite side of the image bearing member. The intermediate transfer belt contacts the image bearing member, and constitutes a transfer nip portion, and the toner image is transferred from the image bearing member to the intermediate transfer belt at the transfer nip portion.

If the peripheral velocity of the image bearing member and that of the intermediate transfer belt are exactly the same in the transfer nip portion, the transfer efficiency drops, and a "void phenomenon", in which the center portion of the toner image of a character, line and the like becomes blank, is generated. Therefore, in Japanese Patent Application Publication No. 2016-1268 the peripheral velocity difference between the image bearing member and the intermediate transfer belt is provided to the peripheral velocity of the image bearing member and that of the intermediate transfer belt, respectively, so that the transfer efficiency is increased and the generation of the void phenomenon is controlled, whereby image improvement is assured.

SUMMARY OF THE INVENTION

However, as a result of closely studying the issue of image quality deterioration (drop in transfer efficiency) caused by the void phenomena, it was discovered that this problem occurs not only due to the influence of the peripheral velocity difference, but also due to the nip width of the transfer nip portion.

An object of the present invention is to provide an image forming apparatus that can suppress the void phenomena caused by a drop in the transfer efficiency, and improve image quality, by using the relationship of the peripheral velocity difference between the image bearing member and the intermediate transfer belt and the nip width of the transfer nip portion, as a parameter.

To solve the above problem, an image forming apparatus of the present invention includes an image forming apparatus, comprising:

an image bearing member;

an intermediate transfer belt onto which a toner image, formed on the image bearing member, is transferred;

a contact member that contacts a surface of the intermediate transfer belt on a side opposite to the image bearing member and forms a transfer nip portion where the intermediate transfer belt and the image bearing member come into contact with each other; and a control unit for controlling a peripheral velocity difference between a peripheral velocity of the intermediate transfer belt and a peripheral velocity of the image bearing member, wherein when a relative moving distance between the image bearing member and the intermediate transfer belt, which is generated in the transfer nip portion due to the peripheral velocity difference, is taken as a shift amount of the toner image, the control unit sets a lower limit value of the shift amount to be at least ⅜ of an average perimeter calculated from a weight-average particle diameter of the toner, which is measured in advance.

According to the present invention, the relationship of the peripheral velocity difference between the image bearing member and the intermediate transfer belt and the nip width of the transfer nip portion is used as a parameter, whereby the void phenomena caused by a drop in the transfer efficiency is suppressed, and image quality can be improved.

Further features of the present invention will become apparent from the following description of exemplary embodiments (with reference to the attached drawings).

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Embodiment 1

Figure 1:
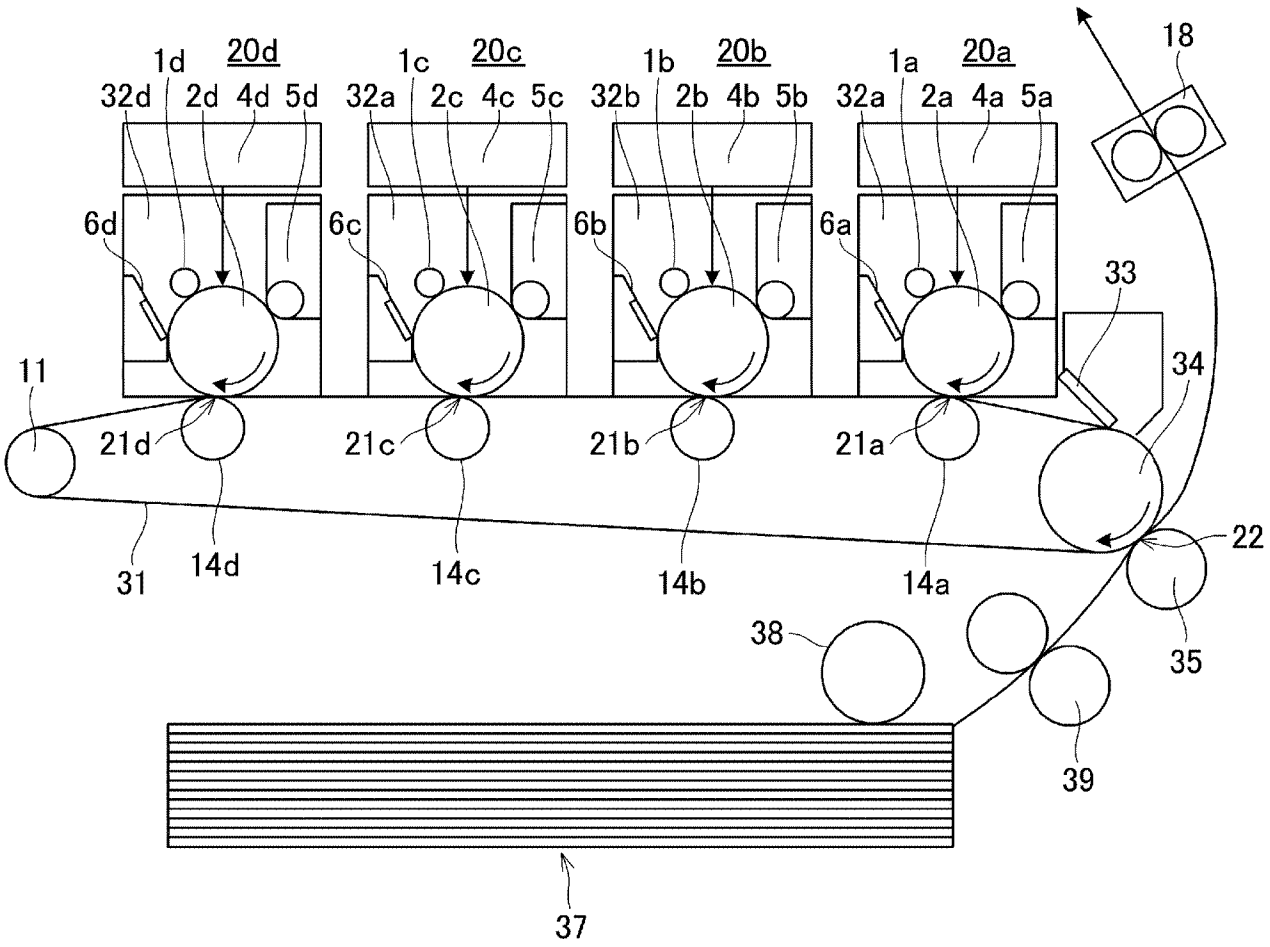
FIG. 1 is a diagram depicting a general configuration of an image forming apparatus according to Embodiment 1 of the present invention.

FIG. 1 is a schematic diagram depicting an example of an image forming apparatus to which the present invention is applied.

This image forming apparatus is a color image forming apparatus using an intermediate transfer belt 31, and includes a plurality of image forming stations 20 which form images of yellow, magenta, cyan and black (hereafter Y, M, C and Bk) colors. In the following description, an alphabetic character a, b, c or d is attached to the reference sign of a member constituting each image forming station for Y, M, C or Bk, respectively, to distinguish each image forming station. If an alphabetic character is not attached, this means that the description is common to all image forming stations 20.

The intermediate transfer belt 31 is an endless belt which is an elastic body having intermediate resistance, and is wound around a secondary transfer counter roller 34 and a belt driving roller 11, which are disposed distant from each other. If the side of moving from the secondary transfer counter roller 34 to the belt driving roller 11 is the outward side, each image forming station 20*a*, 20*b*, 20*c* and 20*d* is disposed in the sequence of Y, M, C and Bk along the outward side surface of the intermediate transfer belt 31.

Each image forming station 20 includes a drum-shaped image bearing member 2 (hereafter called "photosensitive drum 2") on which a toner image is formed, and a plurality of the photosensitive drums 2 are disposed in the moving direction of the intermediate transfer belt 31. The photosensitive drum 2, a charging roller 1, a developing device 5, and a drum cleaner 6 are integrated into a process cartridge 32 which is a processing unit to execute the electrostatic photographing process, and an image exposing unit 4 is disposed adjacent to each process cartridge 32.

On the surface of the intermediate transfer belt 31, that is, on the opposite side of the photosensitive drum 2, a primary transfer roller 14, which is a contacting member, is contacted, whereby a primary transfer unit 21 is configured.

A color image formation, that is performed by this image forming apparatus, will be described next.

The photosensitive drum 2 is rotated in the arrow direction at a predetermined peripheral velocity. In the case of the image forming station 20*a* for the Y color, for example, an image is exposed, by the image exposing unit 4*a*, on the photosensitive drum 2*a* which is uniformly charged by the charging roller 1*a*. Thereby an electrostatic latent image, corresponding to the Y color component image, which is a target color image, is formed on the photosensitive drum 2*a*, then this electrostatic latent image is developed at a developing position by the developing device 5*a*, and is visualized on the photosensitive drum 2*a* as a toner image.

The Y color toner image formed on the photosensitive drum 2*a* is transferred to the intermediate transfer belt 31 by the primary transfer unit 21*a* that applies a reverse polarity voltage to the primary transfer roller 14. Residual toner on the photosensitive drum 2*a* is removed by the drum cleaner 6*a*.

The step of forming the toner image on the photosensitive drum 2*a* and the step of transferring the toner image to the intermediate transfer belt 31 in the image forming station 20*a* are also performed in each image forming station 20*b*, 20*c* and 20*d* for the C, M and Bk colors respectively. As a result, the toner image of each color is superimposed and transferred onto the intermediate transfer belt 31, and a full-color toner image of the four colors is formed.

On the other hand, a transfer material is fed, by a paper feeding roller 38, from a transfer material holding unit 37 which is disposed below the intermediate transfer belt 31, and is fed into a secondary transfer unit 22 by a resist roller pair 39 at a predetermined timing. In this secondary transfer unit 22, the full-color (four-color) toner image is batch-transferred onto the transfer material by the secondary transfer roller 35, which is the secondary transfer member, and is melted and fixed by a fixing device 18, whereby a color print image is formed. The residual toner on the intermediate transfer belt 31 is removed by a belt cleaner 33.

The primary transfer unit 21 of the image forming apparatus will be described next.

Figure 2:
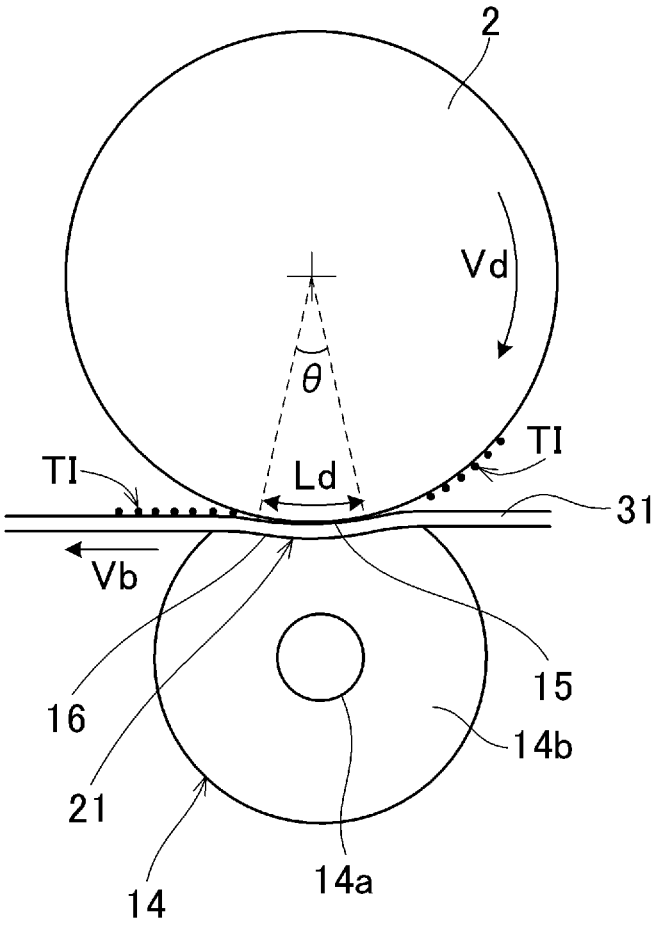
FIG. 2 is an enlarged view of a primary transfer unit in FIG. 1.

FIG. 2 is an enlarged view of the primary transfer unit 21.

In this embodiment, the primary transfer roller 14 is configured by wrapping a core metal 14*a* with an elastic body 14*b* having rubber-like elasticity. In the primary transfer unit 21, the primary transfer roller 14 faces the photosensitive drum 2, sandwiching the intermediate transfer belt 31, and the primary transfer roller 14 presses the photosensitive drum 2 via the intermediate transfer belt 31. The intermediate transfer belt 31 contacts the photosensitive drum 2 by winding around the photosensitive drum 2 for a predetermined length, and this contact region becomes the drum nip portion 15 which constitutes the transfer nip portion. In other words, the transfer nip portion is formed between the intermediate transfer belt 31 and the photosensitive drum 2 as the image bearing member by the primary transfer roller 14 as the transfer member.

If the contact width in the drum nip portion 15 is a drum nip width Ld, the intermediate transfer belt 31 contacts the photosensitive drum 2 by winding around the photosensitive drum 2 for the amount of the drum nip width Ld. The drum nip width Ld is a length of a partial arc of the outer peripheral circle of the circular cross-section of the photosensitive drum 2 in the direction perpendicular to the central axis, and the central angle corresponding to the drum nip width Ld is hereafter called the "winding angle θ".

The photosensitive drum 2 is rotary-driven at a predetermined peripheral velocity Vd (process speed), the intermediate transfer belt 31 is rotated at a predetermined peripheral velocity Vb, whereby the toner image TI is sequentially transferred onto the intermediate transfer belt 31 at the drum nip portion 15. The primary transfer roller 14 rotates in tandem with the intermediate transfer belt 31. The peripheral velocities Vd and Vb of the photosensitive drum 2 and the intermediate transfer belt 31 are the velocities of the drum surface and the belt surface respectively.

A mechanism to improve the transfer efficiency by providing the peripheral velocity difference between the photosensitive drum 2 and the intermediate transfer belt 31 in the drum nip portion 15, which is the premise of the present invention, will be described next with reference to FIGS. 3A and 3B.

Figure 3A:
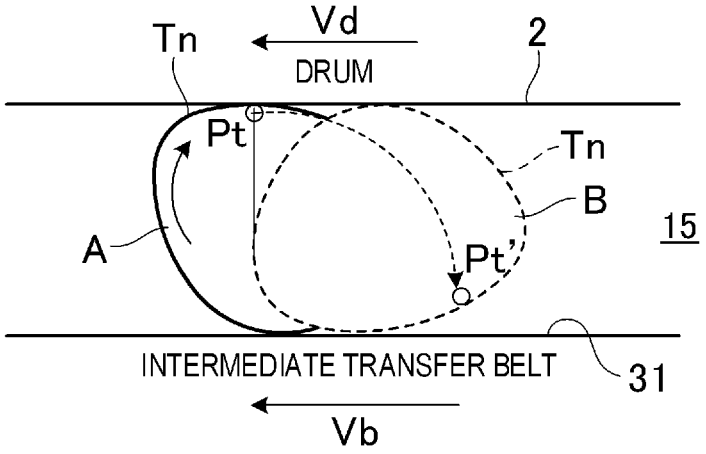
FIGS. 3A and 3B show diagrams depicting the behavior of toner inside a drum nip portion.

FIG. 3A is a schematic diagram depicting inside the drum nip portion 15, where the behavior of toner Tn, in the case of providing the peripheral velocity difference between the photosensitive drum 2 and the intermediate transfer belt 31, is depicted.

In the drum nip portion 15, the photosensitive drum 2 rotates at the peripheral velocity Vd and the intermediate transfer belt 31 rotates at the peripheral velocity Vb, whereby the peripheral velocity difference Vd−Vb (hereafter ΔV) is provided. In Embodiment 1, Vd and Vb have a following relationship, $$Vd<Vb \quad \text{(Expression 1)}$$

that is, the peripheral velocity Vb of the intermediate transfer belt 31 is faster than the peripheral velocity Vd of the photosensitive drum 2 in the configuration of primary transfer.

In the developing process, each toner on the lowest layer adhering to the latent image forming portion on the photosensitive drum 2 has a contact with the photosensitive drum 2. Toner having a contact with the photosensitive drum 2 in many cases is in a stable state, since a section on the surface having a high adhesive force to the photosensitive drum 2 is the contact point. Toner more easily adheres to a point having a high adhesive force, which depends on the surface profile and the surface charge state. Toner adhering at a point having high adhesive force is difficult to transfer, and in order to increase the primary transfer efficiency, a transfer condition that exerts a force higher than the adhesive force is required.

First when the toner Tn enters the drum nip portion 15, the toner Tn rotates like a bearing due to the peripheral velocity difference, and moves from the state A to the state B. Because of this movement, the contact point Pt of the toner Tn and the photosensitive drum 2 moves to the point Pt'. Thereby the contact point Pt which contacts the photosensitive drum 2 and has high adhesive force before entering the drum nip portion 15 is moved away from the photosensitive drum 2, and the adhesive force between the toner Tn and the photosensitive drum 2 decreases.

If there is a peripheral velocity difference, the contact point Pt moves away from the photosensitive drum 2, therefore the relationship between the peripheral velocity Vd of the photosensitive drum 2 and the peripheral velocity Vb of the intermediate transfer belt 31 need not satisfy Expression 1, and the effect of the present invention is implemented even if the relationship between Vd and Vb is reversed.

As described above, the adhesive force between the toner Tn and the photosensitive drum 2 can be decreased by providing the peripheral velocity difference between the photosensitive drum 2 and the intermediate transfer belt 31, whereby the toner Tn can be more easily separated from the photosensitive drum 2, and the primary transfer efficiency improves.

Definition of Shift Amount as Special Parameter

In the present invention, not only the peripheral velocity difference, but also a relative moving distance between the photosensitive drum 2 and the intermediate transfer belt 31, which is generated in the drum nip portion (transfer nip portion) due to the peripheral velocity difference, is set as the shift amount of the toner image caused by the peripheral velocity difference. Then the nip width of the drum nip portion 15 and the peripheral velocity difference ΔV are set so that the shift amount is confined within the range set in advance, whereby the balance of improving the transfer efficiency and preventing the image quality deterioration is optimized.

Now the relationship between the "shift amount" of the toner image and the expansion of the image, which is a unique parameter specified in the present invention, will be described with reference to FIG. 3B. FIG. 3B is a schematic diagram when the toner Tn in FIG. 3A is regarded as a spherical body to simplify description.

The shift amount of the toner image is a relative moving distance between the photosensitive drum 2 and the intermediate transfer belt 31 generated in the drum nip portion 15 due to the peripheral velocity difference, and is defined as follows in this embodiment.

$$\text{Shift amount } (S) = \text{Peripheral velocity difference ratio } (R) \times \text{Drum nip width } (Ld) \quad \text{(Expression 2)}$$

Here, the peripheral velocity difference ratio of the above Expression 2 is taken as a ratio of the peripheral velocity difference |Vd−Vb| between the peripheral velocity Vd of the photosensitive drum 2 and the peripheral velocity Vb of the intermediate transfer belt 31 with respect to the peripheral velocity Vd of the photosensitive drum 2, and is defined by the following expression.

$$\text{Peripheral velocity difference ratio } (R) = |Vd-Vb|/Vd \quad \text{(Expression 3)}$$

The peripheral velocity difference ratio R indicates the relative peripheral velocity difference between the photosensitive drum 2 and the intermediate transfer belt 31, and is not especially limited to Expression 3.

Table 1 shows each shift amount S when the drum nip portion 15 and the peripheral velocity difference ratio R are changed. As shown in Table 1, the shift amount S is a parameter that increases as the peripheral velocity difference ratio R is higher, or as the drum nip width Ld is wider.

TABLE 1

Shift amount (μm) corresponding to the drum nip width and the peripheral velocity difference ratio

| | | Peripheral velocity difference ratio R [%] | | | |
|---|---|---|---|---|---|
| | | 1 | 1.5 | 2 | 3 |
| Drum nip width Ld [mm] | 0.75 | 7.5 | 11.3 | 15.0 | 22.5 |
| | 1.25 | 12.5 | 18.8 | 25.0 | 37.5 |
| | 1.75 | 17.5 | 26.3 | 35.0 | 52.5 |
| | 2.00 | 20.0 | 30.0 | 40.0 | 60.0 |
| | 2.25 | 22.5 | 33.8 | 45.0 | 67.5 |

Now an image expansion of the toner image in the drum nip portion 15, when the peripheral velocity difference is provided to the photosensitive drum 2 and the intermediate transfer belt 31, will be described.

Figure 3B:
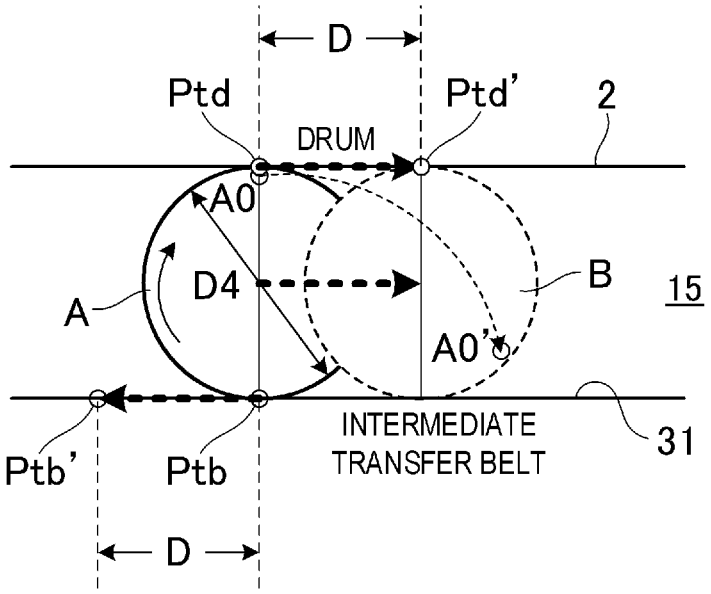

As illustrated in FIG. 3B, when the toner Tn is moved for the distance D by being rotated from the state A to the state B, the position Ptd on the photosensitive drum 2 moves for the distance D to the position Ptd', since the toner Tn moves for the distance D. The point Ptb on the intermediate transfer belt 31 moves for the distance D to the point Ptb' in the opposite direction of the direction of the movement of the photosensitive drum 2. This means that the relative moving distance of the photosensitive drum 2 and the intermediate transfer belt 31 is D×2. In other words, the toner Tn is shifted in the drum nip portion 15 by half the perimeter of the toner Tn, with respect to the relative moving distance of the photosensitive drum 2 and the intermediate transfer belt 31, that is the "shift amount", and as a result, the image expands. In the case of the toner Tn, the point A0, which contacts the photosensitive drum 2 at the position Ptd, moves to A0'.

The range specification of the "shift amount", which is a numeric value specification unique to Embodiment 1, will be described next with reference to FIG. 4.

Figure 4:
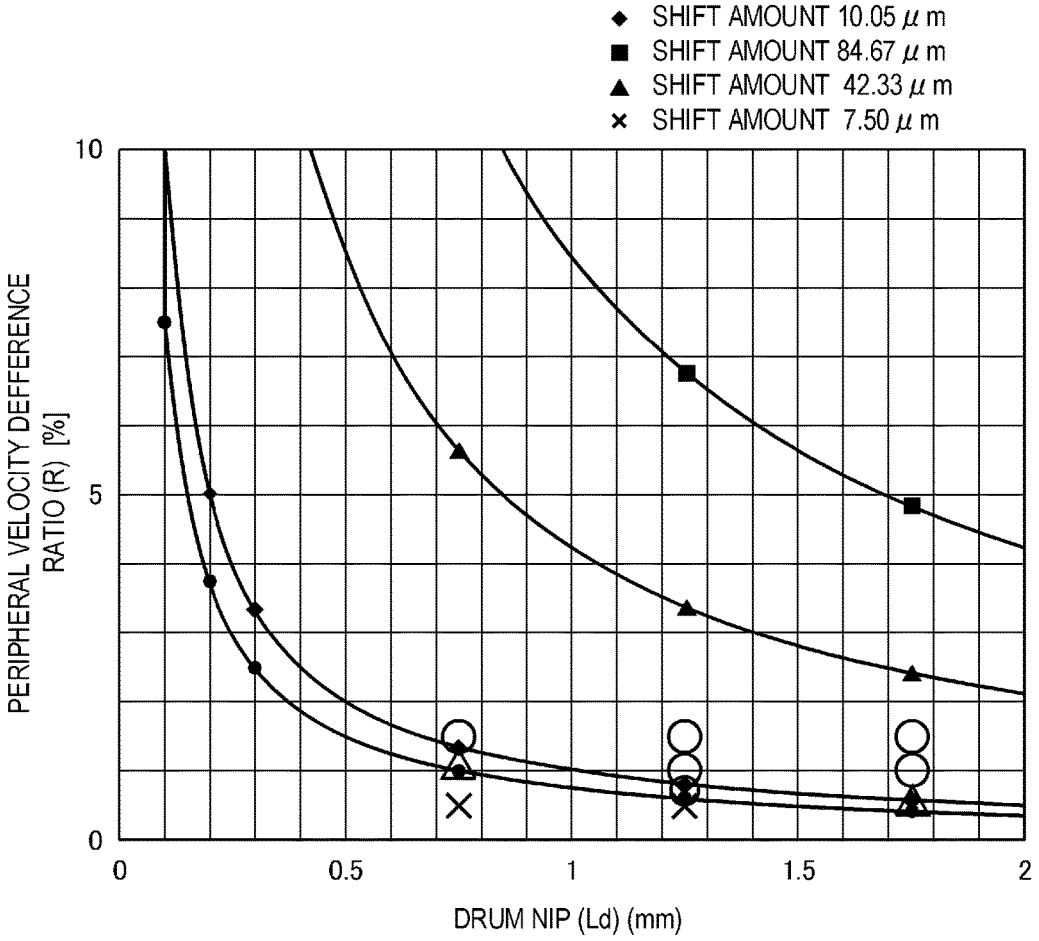
FIG. 4 is a graph depicting the relationship between the drum nip width and the peripheral velocity difference ratio.

In FIG. 4, the abscissa is the drum nip width Ld [mm], and the ordinate is the peripheral velocity difference ratio R [%] indicated by a percentage. The graph shows equal-shift amount curves, which represent the relationship between the peripheral velocity difference ratio R and the drum nip width Ld at three fixed levels of the shift amount S: 10.05 μm;

42.33 μm; and 84.67 μm. When the shift amount S is fixed, the peripheral velocity difference ratio R and the drum nip width Ld are inversely proportional to each other.

The lower limit value of the shift amount S is specified based on the condition that a desired transfer efficiency can be obtained.

Table 2 shows the result when the reflectance corresponding to the reflection density is measured. In other words, a solid image is printed at the M-color station, and a solid image is printed (transferred) at the subsequent C-color station, then the residual toner image on the C-color photosensitive drum, which remained after the transfer, is taped, the reflectance is measured by a reflection-type densitometer (Tokyo Denshoku Co., Ltd., model No. TC-6DS), and Table 2 is the result.

The reflectance is rounded to the nearest integer. 6% and 8% are thresholds, and "O" indicates that the reflectance is 6% or less, "Δ" indicates that the reflectance is more than 6% but not more than 8% (allowable range), and "X" indicates that the reflectance is more than 8%, whereby the reflectance of the residual toner image, after the secondary color solid image is transferred, is evaluated.

TABLE 2

| Reflectance of untransferred toner | | | | |
|---|---|---|---|---|
| | | Peripheral velocity difference ratio R [%] | | |
| | | 0.5 | 1 | 1.5 |
| Drum nip width Ld [mm] | 0.75 | X11.5 | Δ7.8 | O4.9 |
| | 1.25 | X9.5 | O6.2 | O3.9 |
| | 1.75 | Δ8.0 | O6.0 | O3.5 |

A result in Table 2 is plotted on the graph in FIG. 4 using O, Δ and X, then the boundary of the reflectance 6% of the untransferred toner is approximately the curve in FIG. 4, indicating the shift amount 10.05 μm, and the boundary of the reflectance 8% of the untransferred toner is approximately the curve indicating the shift amount 7.5 μm. To make the reflectance of the untransferred toner 6% or less, the image forming apparatus must be used in the upper right side region (region in which shift amount is high) of the graph, with respect to the curve indicating the shift amount 10.05 μm. To make the reflectance of the untransferred toner 8% or less, the image forming apparatus must be used in the upper right side region (region in which shift amount is high) of the graph, with respect to the curve indicating the shift amount 7.5 μm.

Therefore if the shift amount is set to at least 7.5 μm, the reflectance of the untransferred toner can be 8% or less, and if the shift amount is set to at least 10.05 μm, the reflectance of the untransferred toner can be 6% or less.

In this study, a toner of which weight-average particle diameter (D4) is 6.4 μm is used, and if the toner is assumed to have a spherical body (FIG. 3B), the perimeter of the toner is 20.11 μm. The shift amount 7.5 μm, which implements allowable transferability, is about ⅜ the perimeter of the toner, and an arc length that is three times the octant. The shift amount 10.05 μm, which implements preferable transferability, is about half the perimeter of the toner. By rotating about half the perimeter, the initial contact point of the toner Tn with the photosensitive drum 2 moves toward the intermediate transfer belt 31, and the transfer efficiency improves further by ensuring a distance from the photosensitive drum 2 that is sufficient to decrease adhesive force.

As described above, in Embodiment 1, ⅜ of the average perimeter, which is calculated from the weight-average particle diameter of the toner to be used, is set to be the lower limit value by the control unit. It is preferable that to improve the transfer efficiency, the half value of the average perimeter is set to be the lower limit value. The threshold of the allowable reflectance of the untransferred toner is 8% here, but the threshold is not limited to this, and the lower limit of the shift amount may be set to any over to implement a desired transfer efficiency, if the value is at least ⅜ the average perimeter calculated from the weight-average particle diameter of the toner to be used.

How to Measure Weight-Average Particle Diameter (D4) of the Toner

The weight-average particle diameter (D4) of the toner can be calculated as follows.

For the measuring device, the precision particle size distribution measuring device "Coulter Counter Multisizer 3" (Beckman Coulter, Inc.), including a 100 μm aperture tube, based on the pore electric resistance method, is used. To set the measurement conditions and to analyze the measurement data, the dedicated software "Multisizer 3, Version 3.51" (Beckman Coulter, Inc.) is used. The measurement is performed using 25,000 effective measurement channels.

The aqueous electrolytic solution used for the measurement is a solution prepared by dissolving special grade sodium chloride in deionized water at about a 1 mass % concentration, such as "ISOTON II" (Beckman Coulter, Inc.).

Before performing measurement and analysis, the dedicated software is set up as follows.

In the "Change standard measuring method (SOM)" screen of the dedicated software, the total count in control mode is set to 50,000 particles. The number of times of measurement is set to 1, and the Kd value is set to a value obtained using "Standard particle 10.00 μm" (Beckman Coulter, Inc.). The threshold and the noise level are automatically set by depressing the "Threshold/noise level measurement button". The current is set to 1600 μA, gain is set to 2, and the electrolytic solution is set to ISOTON II, then the "Flash aperture tube after measurement" selection is checked.

In the "Convert from pulse to particle diameter" screen of the dedicated software, bin space is set to the logarithmic particle diameter, the particle diameter bin is set to 256, and the particle diameter range is set to 2 μm to 60 μm.

An explanation of the specific measurement method follows.

(1) About a 200 ml aqueous electrolytic solution is poured into a glass type 250 ml round-bottom flask dedicated to the Multisizer 3 device, is then set in the sample stand, and stirred with the stirrer rod counterclockwise at 24 turns/second. Then contamination and bubbles inside the aperture tube are removed using the "Aperture flash" function of the dedicated software.

(2) About 30 ml of aqueous electrolytic solution is poured into a glass type 100 ml flat-bottom flask. Then about a 0.3 ml diluted solution, prepared by diluting "Contaminon N" (10 mass % solution of detergent for cleaning pH7 precision measuring instruments formulated with nonionic surfactant, anionic surfactant and organic builder, from Wako Pure Chemical Industries, Ltd.) with deionized water at about 3 times mass is added as a dispersant.

(3) The ultrasonic dispersion device "Ultrasonic Dispersion System Tetora 150" (from Nikkaki Bios Co., Ltd.) with a 120 W electric output, enclosing two oscillators (50 kHz oscillation frequency) of which phases are shifted 180° from each other, is prepared. About 3.3 l of deionized water is poured into the water tank of the ultrasonic dispersion device, and about 2 ml of Contaminon N is added to this water tank.

(4) The flask in (2) is set in the flask fixing hole of the ultrasonic dispersion device, and the ultrasonic dispersion device is activated. Then the height of the flask is adjusted so that the resonant state of the liquid surface of the electrolytic solution in the flask becomes the maximum.

(5) About 10 mg of toner is gradually added to the electrolytic solution and is dispersed in the state of irradiating ultrasonic waves to the electrolytic solution inside the flask in (4). Then ultrasonic dispersion processing is continued for 60 seconds. In the ultrasonic dispersion, the water temperature in the tank is adjusted to be at least 10° C. and not more than 40° C.

(6) The electrolytic solution in (5), in which toner is dispersed, is dripped into the round-bottom flask in (1), which is set in the sample stand, using a pipette, and is adjusted so that the measurement concentration becomes about 5%. Then measurement is performed until the number of particles that are measured become 50,000.

(7) The measured data is analyzed using the dedicated software bundled with the device, and the weight-average particle diameter (D4) and the number-average particle diameter (D1) are calculated. When the graph/volume % is set in the dedicated software, "average diameter" on the "Analysis/volume statistic value (arithmetic mean)" screen is the weight-average particle diameter (D4). When the graph/quantity % is set in the dedicated software, "average diameter" on the "Analysis/count statistic value (arithmetic mean)" screen is the number-average particle diameter (D1).

Specifications of the upper limit value of the shift amount S will be described next. The upper limit value of the shift amount is specified based on the image expansion.

To guarantee the resolution specified in the image forming apparatus, the maximum value of the image expansion is determined. For example, to guarantee the 600 dpi specification, the image expansion must be controlled to within this resolution (42.33 μm). Therefore the shift amount becomes double this value, that is 84.67 μm, which means that the image forming apparatus has to be used within the lower left region in the graph in FIG. 4 with respect to the curve indicating the 84.67 μm shift amount. To guarantee the 1200 dpi specification, the image expansion must be controlled to within this resolution (21.17 μm). Therefore the shift amount becomes double this value, that is 42.33 μm, which means that the image forming apparatus has to be used within the lower left region in the graph in FIG. 4 with respect to the curve indicating the shift amount 42.33 μm.

In other words, the upper limit value of the shift amount is determined based on the resolution of the image forming apparatus in the moving direction of the intermediate transfer belt 31, and the shift amount S is set to not more than double the resolution in the sub-scanning direction, which is parallel with the moving direction of the intermediate transfer belt 31.

As described above, according to Embodiment 1, the shift amount S is set to a value of at least ⅜, preferably half a value of the average perimeter, calculated from the weight-average particle diameter of the toner which is measured in advance, and not more than double the resolution in the sub-scanning direction which is parallel with the moving direction of the intermediate transfer belt 31. In this range, the drum nip width Ld and the peripheral velocity difference ΔV of the drum nip portion 15 are set. For example, the peripheral velocity Vb of the intermediate transfer belt is determined by adding ΔV to the peripheral velocity Vd of the photosensitive drum.

There are two methods to provide the peripheral velocity difference: a method of providing an independent driving system to the photosensitive drum 2 and the intermediate transfer belt 31 respectively; and a method of providing a common driving system to the photosensitive drum 2 and the intermediate transfer belt 31, and mechanically creating the peripheral velocity difference using a gear ratio or the like. The former can freely set the change of a peripheral velocity difference variable.

Figure 8A:
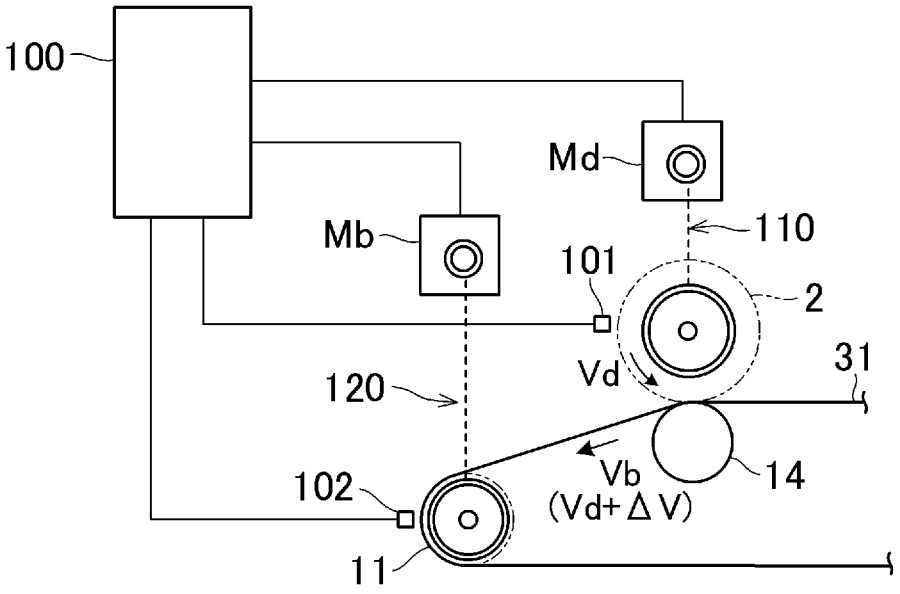
FIGS. 8A and 8B show control block diagrams of the photosensitive drum and the intermediate transfer belt in FIG. 1.

FIG. 8A is a schematic diagram depicting an example of the configuration in which the photosensitive drum 2 and the intermediate transfer belt 31 have an independent driving system respectively.

The photosensitive drum 2 is driven by a drum driving motor Md via a transmission mechanism 110 (e.g. a gear), and the intermediate transfer belt 31 is driven by a belt driving motor Mb via a transmission mechanism 120 (e.g. a gear). The rotation velocity of each motor Md and Mb is set to correspond to the target peripheral velocity Vd of the photosensitive drum 2 or the peripheral velocity Vb of the intermediate transfer belt 31 by the control unit 100, which includes a CPU. The peripheral velocity Vd and Vb can be freely set, hence the peripheral velocity difference ΔV can be freely set within the predetermined range of the shift amount. The peripheral velocity of the photosensitive drum 2 and that of the intermediate transfer belt 31 are sequentially detected by the velocity sensors 101 and 102 respectively, and are fed back to the control unit 100, so as to be controlled to maintain the set values.

Figure 8B:
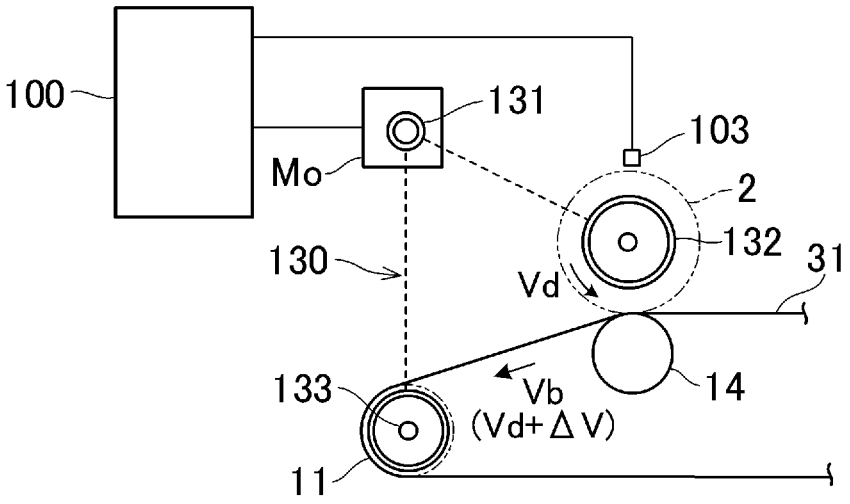

FIG. 8B is a schematic diagram depicting an example when a common driving system is used.

In the driving system, power is transferred from a common motor Mo, which is a driving source, to the photosensitive drum 2 and the belt driving roller 11 of the intermediate transfer belt 31.

In this case, the peripheral velocity Vd of the photosensitive drum 2 is determined by the rotation velocity of the motor Mo, the gear ratio of the motor gear 131 and the drum driving gear 132, and the outer diameter of the photosensitive drum 2. The peripheral velocity Vb of the intermediate transfer belt 31 is determined by the rotation velocity of the motor Mo, the gear ratio of the motor gear 131 and the roller driving gear 133, the diameter of the belt driving roller 11, and the thickness of the intermediate transfer belt 31. Therefore by changing the gear ratio, the peripheral velocity of the photosensitive drum 2 and the velocity transmission ratio can be changed, and a predetermined peripheral velocity difference can be provided to the peripheral velocity Vd of the photosensitive drum 2, and the peripheral velocity Vb of the intermediate transfer belt 31.

To verify the peripheral velocity difference, the surface velocity of the photosensitive drum 2 and that of the intermediate transfer belt 31 are measured by a speed meter (e.g. laser Doppler type), and compared.

A method of calculating the drum nip width of the drum nip portion 15 will be described next with reference to FIGS. 5A and 5B and FIG. 6.

Figure 5A:
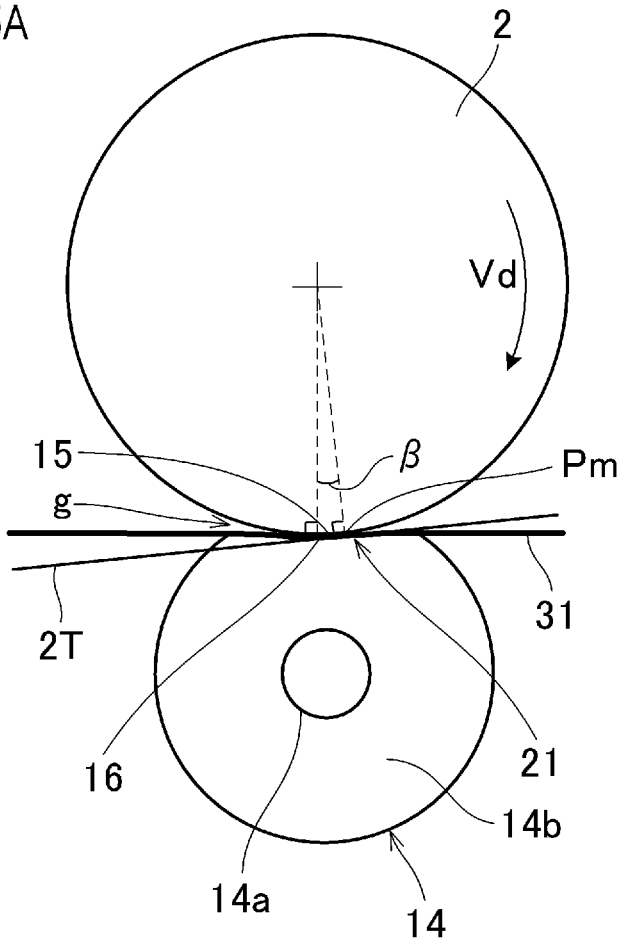
FIGS. 5A and 5B show diagrams depicting the relationship of forces that act on the primary transfer unit in FIG. 2.
Figure 5B:
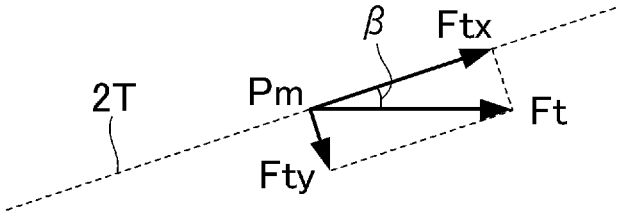

FIGS. 5A and 5B show the relationship among forces that act on the primary transfer unit 21.

The drum nip portion 15 is formed by the primary transfer roller 14 (an elastic body) which pushes the intermediate transfer belt 31 into the photosensitive drum 2 (a rigid body). Since tension is applied to the intermediate transfer belt 31, a non-contact region g is generated, where the primary transfer roller 14 cannot press the intermediate transfer belt 31 into the photosensitive drum 2 as shown in FIG. 5A. Therefore, the nip width of the drum nip portion 15 tends to be narrower than the nip portion 16 where the primary transfer roller 14 and the intermediate transfer belt 31 contact (hereafter called "roller nip portion 16"). The point Pm is the edge of the drum nip portion 15, and the drum tangential line 2T at the point Pm is indicated by a broken line.

FIG. 5B is a schematic diagram when the tension force Ft of the intermediate transfer belt 31, which acts on the edge point Pm of the drum nip portion 15, is divided into the force Ftx in the direction of the drum tangential line 2T at the point Pm, and the force Fty in the direction perpendicular to the drum tangential line 2T. The force Fty in the direction perpendicular to the drum tangential line 2T is one of the forces which presses the primary transfer roller 14 down.

The bending stress Fb (not illustrated) of the intermediate transfer belt 31, on the other hand, becomes an inhibitory force against the pressing force when the primary transfer roller 14 presses the intermediate transfer belt 31 into the photosensitive drum 2. If the pressing force, when the primary transfer roller 14 presses the intermediate transfer belt 31 up, is Fr, then the following relationship is established at the point Pm, $$Fr=Ft\cdot\mathrm{Tan}\ \beta+Fb \qquad \text{(Expression 4)}$$

and the pressing force of the primary transfer roller 14 on the left hand side and the sum of the inhibitory forces thereof on the right hand side are balanced at the edge of the drum nip. Here Fr is given by the following Expression 5.

$$Fr=E\cdot\varepsilon \qquad \text{(Expression 5)}$$

In Expression 5, E denotes the Young's modulus of the rubber constituting the elastic body 14*b* of the primary transfer roller 14, and c is a distortion of the primary transfer roller 14. If the right hand side of Expression 4 is smaller than the left hand side of Expression 4, the pressing force, exerted by the primary transfer roller 14, exceeds the inhibitory force thereof, and the drum nip portion 15 can be formed.

Therefore, the drum nip width Ld can be calculated by deriving the position of the point Pm on the photosensitive drum 2 from the transfer pressure of the primary transfer roller 14, the physical property value of the rubber of the elastic body 14*b*, the tension of the intermediate transfer belt 31, and the physical property value of the intermediate transfer belt 31.

To verify the drum nip width Ld of the drum nip portion 15, "Abaqus/Standard, Ver. 6.91", a structural analysis software from Dassault Systems K.K., is used.

Table 3 shows the parameters used to calculate the drum nip width and concrete values thereof. The parameters are: outer diameter of the photosensitive drum 2; outer diameter of the primary transfer roller 14; longitudinal length of the primary transfer roller 14; thickness of the rubber of the elastic body 14*b* of the primary transfer roller 14; and Young's modulus of the rubber of the elastic body 14*b* of the primary transfer roller 14. Other possible parameters are: belt tension of the intermediate transfer belt 31; Young's modulus of the belt; thickness of the belt; roller weight of the primary transfer roller 14; and the weighting direction with respect to the intermediate transfer belt 31.

TABLE 3

Parameters to calculate drum nip

| Parameter | Value |
|---|---|
| Outer diameter of photosensitive drum | 24 mm |
| Outer diameter of transfer roller | 14 mm |
| Longitudinal length of transfer roller | 225 mm |
| Rubber thickness of transfer roller | 4.0 mm |
| Young's modulus of rubber of transfer roller | 0.10 MPa |
| Tension of belt | 5.0[N/mm] |
| Young's modulus of belt | 1350[Mpa] |
| Thickness of belt | 0.07[mm] |
| Weighting direction | Vertical |

Figure 6:
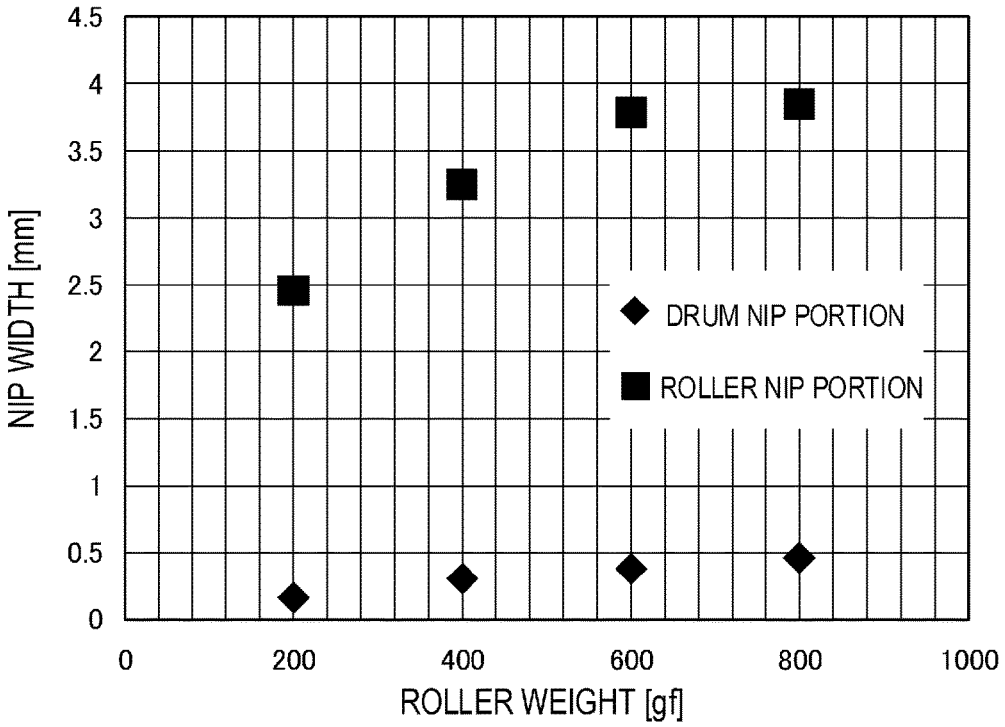
FIG. 6 is a diagram depicting a relationship between the weight applied to the primary transfer roller in FIG. 2 and the drum nip width.

FIG. 6 shows the result of analyzing the nip width at the drum nip portion 15 and the roller nip portion 16 with these parameters, when the weighting that is applied to the primary transfer roller 14 is changed from 200 gf to 800 gf in 200 gf intervals.

According to FIG. 6, when the weighting of the roller increases, both the nip width of the drum nip portion 15 and that of the roller nip portion 16 increase, but the amount of increase of the nip width in the drum nip portion 15 is smaller than that in the roller nip portion 16. For example, when the weight is 400 gf, the nip width of the drum nip portion 15 is 0.32 mm.

The drum nip width Ld of the drum nip 15 can be determined by laying color material, such as toner, on the intermediate transfer belt 31, contacting and separating the intermediate transfer belt 31 in this state to/from the photosensitive drum 2, and measuring the width of the color material that is transferred onto the photosensitive drum 2. In this case, it must be noted that the width of the transferred color material tends to be large, depending on the laid-on level and thickness of the color material.

As described above, according to Embodiment 1, the "shift amount" is specified as a parameter related to the drum nip portion 15 and the peripheral velocity difference between the photosensitive drum 2 and the intermediate transfer belt 31, whereby both the transfer efficiency (void prevention) and the image quality (preventing image expansion) can be implemented.

Other embodiments of the present invention will be described next. In the following description, only aspects that are different from Embodiment 1 will be described, and the same composing elements as Embodiment 1 are denoted with the same reference signs, for which redundant description will be omitted.

Embodiment 2

Figure 7A:
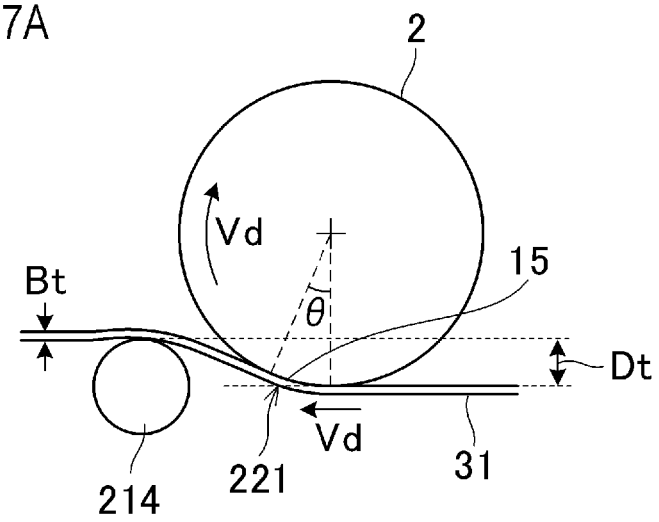
FIGS. 7A and 7B show diagrams depicting a configuration of a primary transfer unit according to Embodiment 2.
Figure 7B:
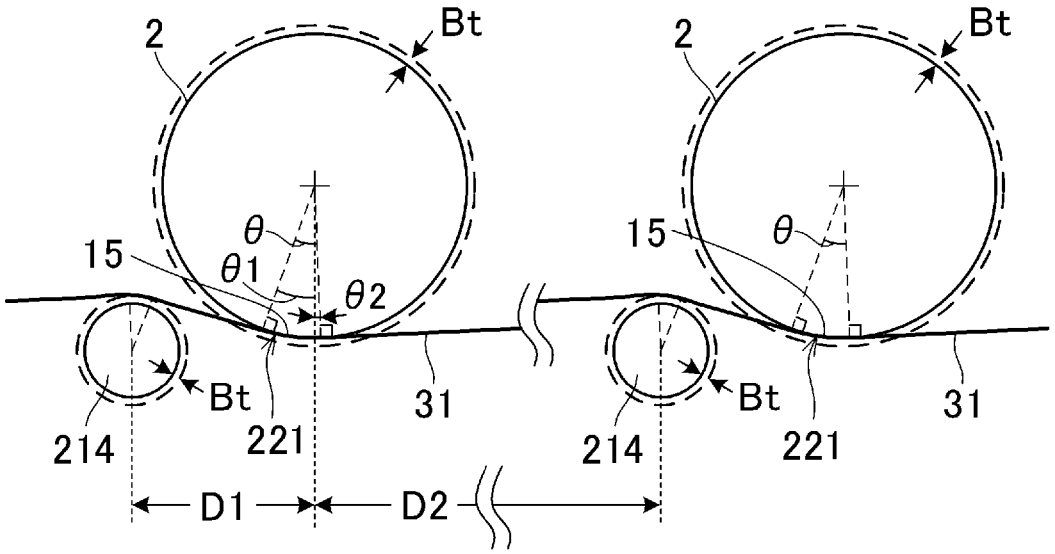

FIGS. 7A and 7B show a primary transfer unit 221 according to Embodiment 2 of the present invention, where FIG. 7A is a cross-sectional view of an image forming station, and FIG. 7B is a diagram depicting the relationship between two image forming stations.

For the primary transfer member, a primary transfer roller 14, configured by wrapping a core metal 14*a* with an elastic body 14*b* (e.g. rubber), is normally used as in the case of Embodiment 1, but in Embodiment 2, a metal roller 214 constituted only by a rigid metal body is used. In the configuration of using the metal roller 214, the primary transfer unit 221 is disposed on the upstream side or downstream side of the photosensitive drum 2 in the transporting direction of the intermediate transfer belt 31, with offsetting of the metal roller 214. By disposing the metal roller 214 in an offset position, the intermediate transfer belt 31 is not sandwiched between the photosensitive drum 2 and the metal roller 214, and the drum nip portion 15 is constituted by winding the intermediate transfer belt 31 around the photosensitive drum 2.

To ensure a desired transfer pressure in the drum nip portion 15, the penetration level of the metal roller 214 into the photosensitive drum 2 tends to increase. Therefore, the winding amount of the intermediate transfer belt 31 around the photosensitive drum 2 increases and the nip width of the drum nip portion 15 increases, compared with the case of the primary transfer roller 14 using an elastic body 14*b* (e.g., rubber). If the peripheral velocity difference is provided in this state, the shift amount increases, even if the peripheral velocity difference ratio is set low, which increases the risk of image defects.

The meaning of the shift amount, the effect of the shift amount on transfer efficiency and the image expansion are still the same even if the metal roller 214 is used, and the specification range of the shift amount is the same as Embodiment 1. In the configuration of the metal roller 214, the drum nip portion 15 can be measured by measuring the position of the members three-dimensionally.

The method of calculating the drum nip 15 will be described next.

As illustrated in FIG. 7A, the metal roller 214 is disposed on the downstream side of the intermediate transfer belt 31 in the rotating direction, and is raised toward the photosensitive drum 2 side by a pressing member (not illustrated) so as to ensure a desired transfer pressure, and penetrates into the photosensitive drum 2 side with a penetration level Dt.

$$\text{Drum nip width } (Ld) = \text{drum perimeter} \times (\theta/360°) \quad \text{(Expression 6)}$$

Here as illustrated in FIG. 7B, $$\theta = \tan^{-1}((Dt+Bt)/D1) + \tan^{-1}((Dt+Bt)/D2) \quad \text{(Expression 7)}$$

and the winding angle θ [°] is a winding angle when the surface of the intermediate transfer belt 31 contacts the surface of the photosensitive drum 2, and Bt is a thickness of the intermediate transfer belt 31. D1 and D2 are the distance from the metal roller 214 to the photosensitive drum 2, and the distance from the photosensitive drum 2 to the metal roller 214 of the adjacent station respectively. In the case of Embodiment 2, the winding angle θ is given by the sum of the winding angle θ1 of the metal roller 214 of this station and the winding angle θ2 of the metal roller 214 of another station adjacent to this photosensitive drum 2.

Here the winding angle θ is not limited to Expression 7, but may be determined simply by approximating the angle when the surface of the intermediate transfer belt 31 is wound around the photosensitive drum 2. As the primary transfer member, the metal roller 214 has been described as an example, but the primary transfer member is not limited to the metal roller 214, as long as a configuration winding the intermediate transfer belt 31 around the photosensitive drum 2 with a predetermined penetration level is used.

A member which implements the winding of the intermediate transfer belt 31 around the photosensitive drum 2, even without having the primary transfer function, may be used, and the winding angle in this case may be regarded as the winding angle θ.

As described above, even in the configuration where the drum nip width is increased by winding the intermediate transfer belt 31 around the photosensitive drum 2, as in the case of Embodiment 2, the balance of the transfer efficiency and the deterioration of image quality can be optimized by specifying the "shift amount".

Embodiment 3

Embodiment 3 of the present invention will be described next.

The upper limit value of the shift amount of Embodiment 1 is determined based on the image expansion guaranteeing the resolution specified for the image forming apparatus, but in the case of a low resolution image forming apparatus, the upper limit value of the shift amount becomes high enough to visually recognize the deterioration of the image quality of the printed matter, which is not desirable.

In Embodiment 3, the upper limit value of the shift amount is specified based on the result of a subjective evaluation experiment, where the level of image deterioration is determined based on subjectivity.

For the evaluation pattern, the character "電" in Mincho font was used, and a 6-point single color character and a 6-point single color outline character were evaluated. In the evaluation environment, a D50 light source illumination was used, and a subjective evaluation experiment was performed with 10 individuals. Samples were printed under 16 types of conditions, combining 4 levels of drum nip width Ld (0.75, 1.25, 1.75 and 2.25 [mm]), and 4 levels of peripheral velocity difference ratio R (1.0, 1.5, 2.0 and 3.0 [%]).

The evaluated values were averaged in each sample, and the test result was classified into 4 categories indicated as: O: deterioration is not detected; Δ: deterioration is detected but allowable; X: deterioration is not allowable but the character can be recognized (character is readable); and XX: character cannot be recognized (character is not readable).

Table 4 is the result when a 6-point single color black character was used, and Table 5 is the result when a 6-point single color outline character was used.

TABLE 4

Image quality deterioration evaluation test result (Mincho 6-point single color black character)

| | | Peripheral velocity difference ratio R [%] | | | |
|---|---|---|---|---|---|
| | | 1 | 1.5 | 2 | 3 |
| Drum nip width Ld [mm] | 0.75 | O | O | O | O |
| | 1.25 | O | O | O | X |
| | 1.75 | O | Δ | X | XX |
| | 2.00 | O | Δ | X | XX |
| | 2.25 | O | X | XX | XX |

TABLE 5

Image quality deterioration evaluation test result (Mincho 6-point single color outline character)

| | | Peripheral velocity difference ratio R [%] | | | |
|---|---|---|---|---|---|
| | | 1 | 1.5 | 2 | 3 |
| Drum nip width Ld [mm] | 0.75 | O | O | O | Δ |
| | 1.25 | O | O | Δ | X |
| | 1.75 | O | Δ | X | XX |
| | 2.00 | O | Δ | X | XX |
| | 2.25 | O | X | XX | XX |

If [Table 5] is compared with Table 1, it is clear that the image expands in the sub-scanning direction as the shift amount increases, and the character quality deteriorates accordingly. A comparison of Table 4 and Table 5 shows that the outline character deteriorates more than the black character, that is, the outline character is more sensitive to deterioration due to the peripheral velocity difference. In the comparison with Table 1, it is known that for both the black character and the outline character, the allowable levels O and Δ occur when the shift amount is 30 μm or less. Therefore 30 μm is set as the threshold, and the shift amount exceeding 30 μm is regarded as outside the allowable range of character quality deterioration.

As described above, it is preferable that the upper limit of the shift amount is set to 30 μm in terms of maintaining character quality.

An effect specific to Embodiment 3 is that deterioration of the image quality is controlled to within a practical allowable level by specifying the upper limit of the "shift amount" based on subjective judgment, whereby the primary transfer configuration can be implemented considering the balance of the transfer efficiency and practical image quality.

Embodiment 4

Figure 9A:
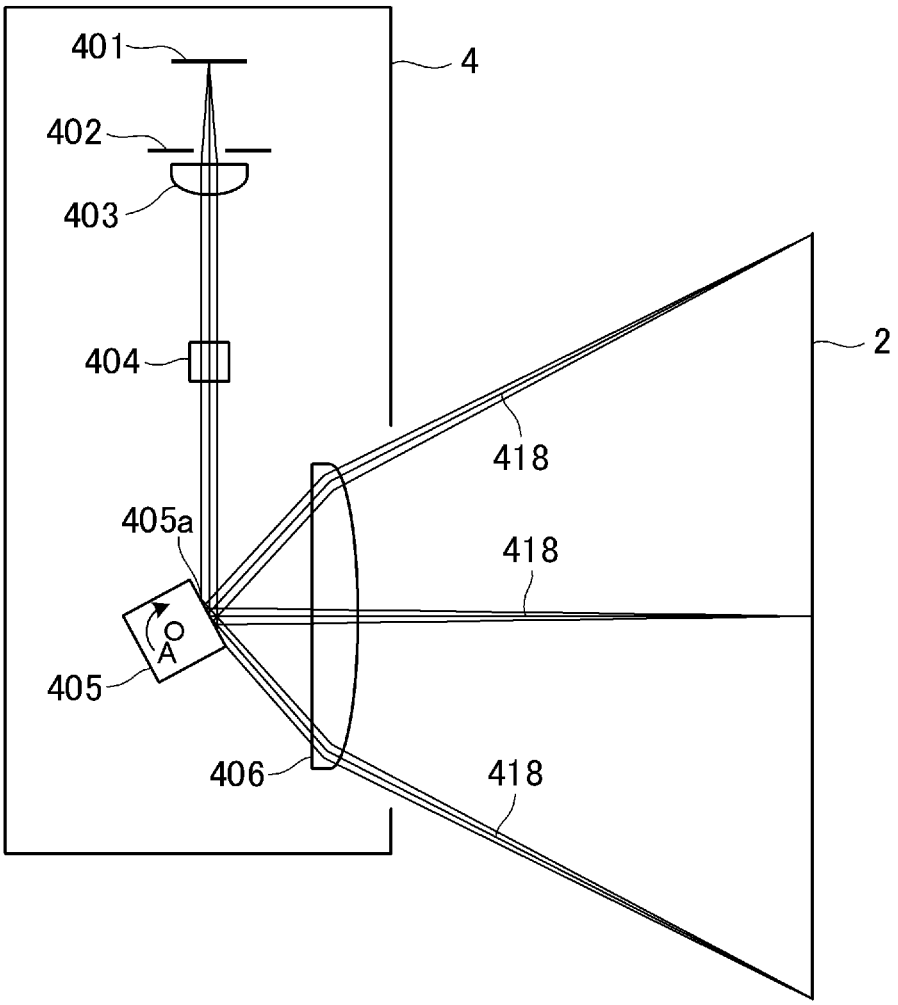
FIGS. 9A and 9B show diagrams depicting the configuration of an image exposing unit as an exposing unit according to Embodiment 4 of the present invention.
Figure 9B:
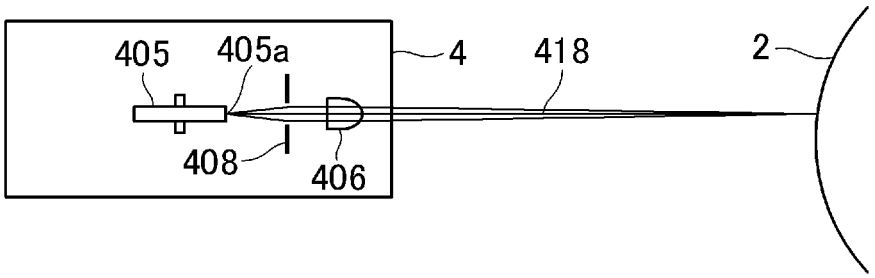

Embodiment 4 of the present invention will be described next. In Embodiments 1 to 3, the shift amount is specified to within a range whereby character quality does not deteriorate. Embodiment 4 concerns a mechanism in which the spot shape of the laser beam is set in order to form a latent image having an aspect ratio that cancels the shift amount in advance. FIGS. 9A and 9B show an image exposing unit 4 which is an exposing unit according to Embodiment 4 of the present invention, where FIG. 9A is a main scanning cross-section, and FIG. 9B is a sub-scanning cross-section.

In Embodiment 4, the laser beam (luminous flux) 418, emitted from a light source 401, enters a coupling lens 403 after the luminous flux diameter in the main scanning direction is limited by a main scanning aperture 402. The luminous flux that passes through the coupling lens 403 is converted into an approximately parallel light, and enters an anamorphic lens 404. The anamorphic lens 404 condenses the luminous flux to a deflector (polygon mirror) 405 in the sub-scanning cross-section, and forms a linear image that is long in the main scanning direction.

The luminous flux condensed to the deflector 405 is reflected by a deflecting surface 405*a* (hereafter called "reflecting surface 405*a*") of the deflector 405. The luminous flux reflected by the reflecting surface 405*a*, of which luminous flux diameter in the sub-scanning direction is limited by a sub-scanning aperture 408, is shaped to be approximately circular, and transmits through an imaging lens 406, and enters the surface of the photosensitive drum 2. The luminous flux forms an image on the photosensitive drum 2 by the imaging lens 406, and forms a predetermined spot image (hereafter called a "spot"). By rotating the deflector 405 in the arrow A direction at a predetermined angular velocity using a driving unit (not illustrated), the spot moves on the photosensitive drum 2 in the main scanning direction, and forms an electrostatic latent image on the photosensitive drum 2.

The main scanning direction is a direction that is parallel with the surface of the photosensitive drum 2, and is perpendicular to the moving direction on the surface of the photosensitive drum 2. The sub-scanning direction is a direction that is perpendicular to the main scanning direction, and is perpendicular to the optical axis of the luminous flux. The spot diameter in the main scanning direction (main scanning spot diameter) is defined as a width, when the light quantity profile, obtained by integrating a static spot profile, which is formed on the surface of the photosensitive drum 2 (scanned surface) in the sub-scanning direction, is sliced at a position that is 13.5%, for example, with respect to the maximum value of the light quantity profile. The spot diameter in the sub-scanning direction (sub-scanning spot diameter) is defined as a width, when the light quantity profile, obtained by integrating a static spot profile, which is formed on the surface of the photosensitive drum 2 (scanned surface) in the main scanning direction, is sliced at a position that is 13.5%, for example, with respect to the maximum value of the light quantity profile. The static spot diameter is measured by a CCD camera installed at the position of the photosensitive drum 2. In this embodiment, the CCD camera "TAKEX-NC300" is used. For measurement, the spot profile of the laser beam is obtained by making the light source 401 to emit in a state where the angle of the deflector 405 is adjusted, so that the laser beam 418 enters the CCD camera. The spot diameter does not depend on the light quantity, hence the emission intensity for the measurement may be an arbitrary level.

The unit dot shape of the latent image that is formed on the photosensitive drum 2 by this spot will be described next. The size of the unit dot of the latent image in the main scanning direction is defined as a width, when a dynamic spot profile, which is formed on the surface of the photosensitive drum when the laser beam is emitted for a unit time while scanning in the main scanning direction, is sliced at a position that is 13.5%, for example, with respect to the maximum value of the dynamic spot profile. The size of the unit dot of the latent image in the sub-scanning direction is defined as a width, when the light quantity profile obtained by integrating a statistic spot profile, which is formed on the surface of the photosensitive drum 2 (scanned surface) in the main scanning direction, is sliced at a position that is 13.5%, for example, with respect to the maximum value of the light quantity profile. The unit dot diameter is measured while scanning the laser beam 418 in the main scanning direction, while rotating the deflector 405 by a driving unit (not illustrated) in the arrow A direction at a predetermined angular velocity, but the measurement method is the same as the case of measuring the static spot diameter. This unit dot is the minimum unit to form an image, and all images are constituted by unit dots. In other words, the image quality, including the character quality, is determined by the shape of the unit dot. An approximate size of the unit dot in the sub-scanning direction is determined by the static profile of the spot, that is, by the sub-scanning spot diameter. The size of the unit dot in the main scanning direction, which is the scanning direction of the laser, is larger than the static main scanning spot diameter.

Generally it is preferable that the main/sub-scanning spot diameter of the laser beam is set to such a size that the toner image, visualized by developing the toner in this unit dot of the latent image, has a size similar to the resolution ensured by the image forming apparatus. In other words, to ensure 600 dpi in the image forming apparatus specifications, the spot diameter is set by adjusting the main scanning aperture 402 and the sub-scanning aperture 408, so that the unit dot diameter after development becomes about 42 μm in the main/sub-scanning directions. To ensure 1200 dpi as stated in the specifications, the spot diameter is set by adjusting the main scanning aperture 402 and the sub-scanning aperture 408, so that the unit dot diameter becomes about 21 μm.

To measure the size of the visualized toner image of the unit dot, which is formed on the photosensitive drum 2, laser microscope One Shot VR 300 (Keyence Corporation) is used, which captures the toner image by an ×80 lens. To calculate the main scanning diameter and the sub-scanning diameter, a bundled analysis application software is used, and the size of the dot is measured using a point-to-point measuring function in analysis mode. At this time, to prevent measurement dispersion depending on the measuring technician, the boundary around the dot is extracted in automatic edge extraction mode, which is an auxiliary function, and measurement is performed. Further, the measurement dispersion is reduced by measuring dots at 3 or more locations, which include at least the center and both edges of the photosensitive drum 2, and averaging the measurement results. The toner image on ITB after the primary transfer and the toner image on paper after fixing can also be measured in the same manner.

Because of the above, a toner image having an accurate size, which is not expanded/contracted from the original image, can be formed on the drum.

However, when a toner image which has an accurate size, and which is not expanded/contracted from the original image, is formed on the drum, the image expands in the sub-scanning direction in the primary transfer step if the peripheral velocity difference is provided, and horizontal lines become thicker than the vertical lines. Therefore in this embodiment, the main scanning aperture 402 and the sub-scanning aperture 408 are adjusted, whereby the unit dot diameter of the latent image on the surface of the photosensitive drum 2 (surface of image bearing member), which is a scanned surface (exposed surface), is limited to the size given by the following Expression 8.

Size in the sub-scanning direction of a unit dot of the latent image formed on the photosensitive drum 2=size in the main scanning direction of a unit dot of the latent image corresponding to a toner image having a size which is not expanded/contracted from the original image−the above mentioned shift amount×½ (Expression 8)

Figure 10:
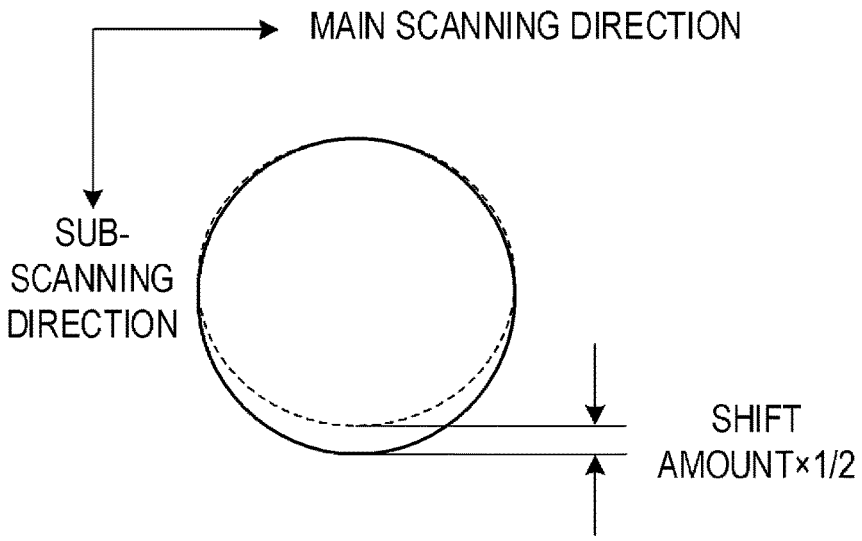
FIG. 10 is a schematic diagram depicting the size of a unit dot on the image bearing member according to Embodiment 4 of the present invention.

In other words, as illustrated in FIG. 10, the aspect ratio of the unit dot of the latent image on the scanned surface is changed, so that the size of the unit dot in the sub-scanning direction is decreased in advance for the amount of the image expanded by the peripheral velocity difference. Then a latent image, which is contracted for the amount of the image expanded in the sub-scanning direction, in accordance with the aspect ratio of the unit dot, is formed on the photosensitive drum, and the toner image developed on this latent image is also contracted accordingly. The toner image which is contracted in the sub-scanning direction on the drum is expanded in the sub-scanning direction in the subsequent primary transfer step, in accordance with the drum nip width and the peripheral velocity difference, and after the primary transfer, the expansion/contraction from the original image is negated to zero.

By the above processing, even if the image is expanded in the sub-scanning direction due to the peripheral velocity difference, the amount of the expansion is negated, and a high quality image which accurately represents the original image can be obtained.

In this embodiment, the unit dot diameter is limited so that the vertical size and the horizontal size become the same, but according to the study by the present applicant, it is sufficient if the aspect ratio of the dot is within 10% in terms of guaranteeing character quality, and the unit dot diameter may be set in a range given by the following Expression 9.

Size in the sub-scanning direction of a unit dot of the latent image formed on the photosensitive drum 2=(size in the main scanning direction of a unit dot of the latent image corresponding to a toner image having a size which is not expanded/contracted from the original image−shift amount×½)×0.9 to (size in the main scanning direction of a unit dot of the latent image corresponding to a toner image having a size which is not expanded/contracted from the original image−shift amount×½)×1.1 (Expression 9)

As described above, expansion of the image can be prevented if the unit dot diameter of the latent image is set according to Embodiment 4, by adjusting the main scanning aperture 402 and the sub-scanning aperture 408, and the primary transfer configuration, which implements a balance of both the transfer efficiency and the practical image quality, can be constructed.

Embodiment 5

Embodiment 5 of the present invention will be described next.

From the perspective of the expansion of the image, the upper limit value of the shift amount is set to double the resolution in the sub-scanning direction in Embodiment 1, and is set to 30 μm in Embodiment 3, so as to confine the expansion of the image to within an allowable range.

Figure 11:
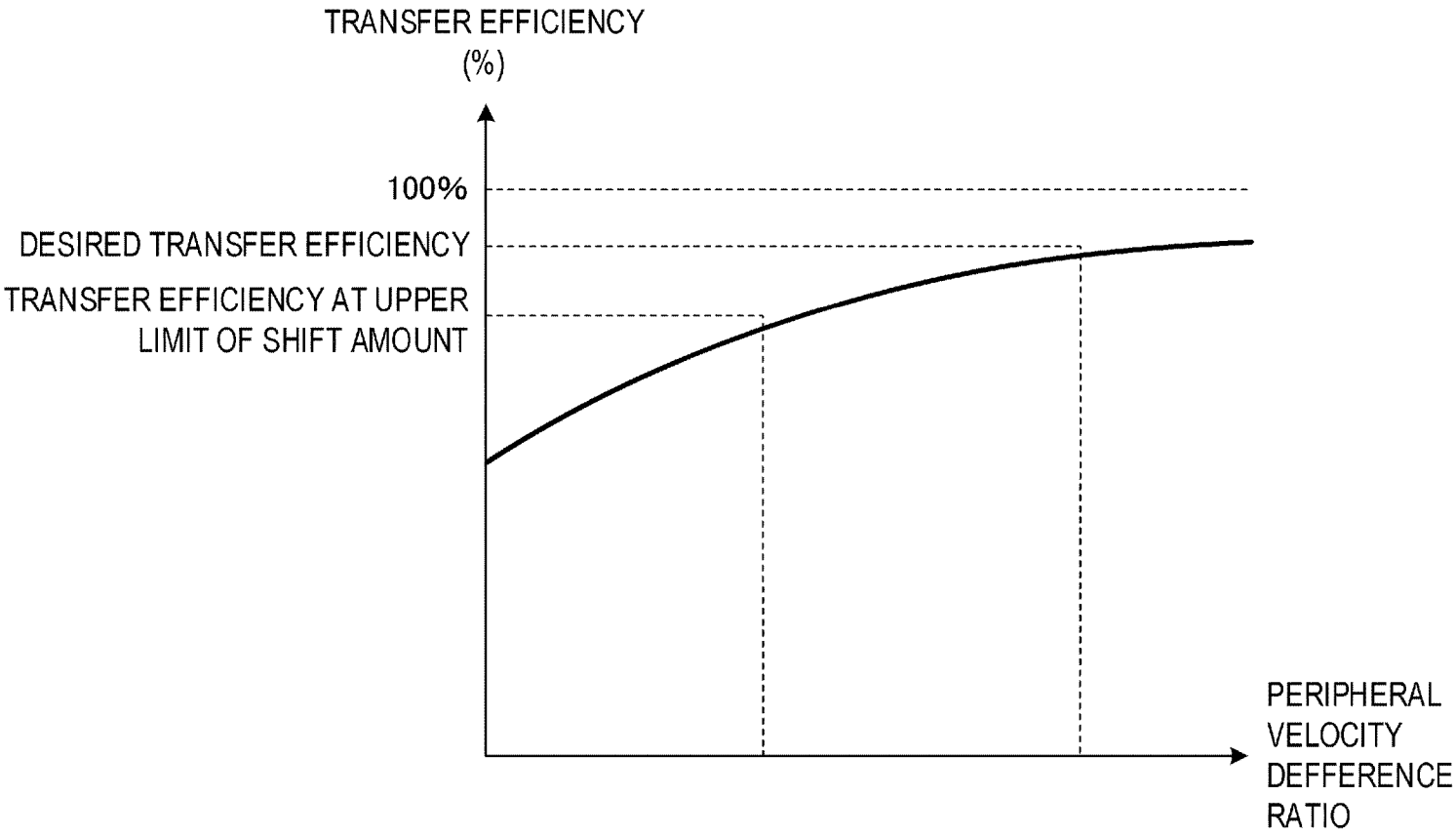
FIG. 11 is a graph depicting the relationship between the transfer efficiency and the peripheral velocity difference ratio.

From the perspective of the transfer efficiency, on the other hand, a larger peripheral velocity difference ratio is required in some cases, in order to obtain a desired transferability, and the shift amount may exceed the above mentioned upper limit value. FIG. 11 shows a relationship between the peripheral velocity difference ratio and the transfer efficiency. In FIG. 11, the abscissa indicates the peripheral velocity difference ratio, and the ordinate indicates the transfer efficiency, and it is shown that the transfer efficiency improves as the peripheral velocity difference ratio is increased.

This embodiment relates to a configuration in which the shape of the unit dot is limited in advance, so that the expansion of the image is confined to within the allowable range in the case when the shift amount exceeds the upper limit value.

First a method of setting the upper limit value of the shift amount to at least double the resolution in the sub-scanning direction, will be described in comparison with Embodiment 1.

Figure 12:
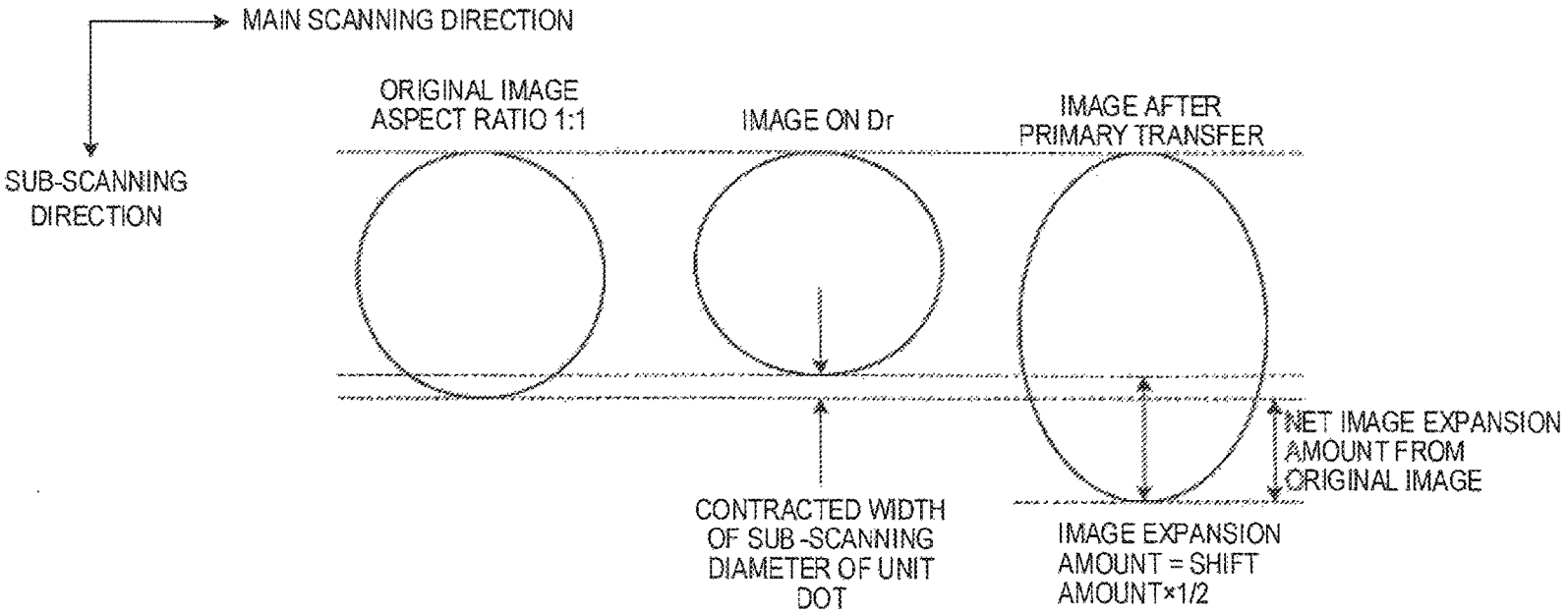
FIG. 12 is a schematic diagram depicting the unit dot diameter in the sub-scanning direction and the expansion/contraction of the toner image.

FIG. 12 is a schematic diagram depicting the relationship between the unit dot diameter and the expansion/contraction of the toner image.

As illustrated in FIG. 12, the net expansion amount from the original image is smaller than the actual image expansion amount (shift amount×½) by the amount of decrease of the unit dot diameter in the sub-scanning direction.

In other words, if the unit dot size is decreased to an appropriate size in advance, the net image expansion amount from the original image can be maintained to the resolution in the sub-scanning direction or less, even if the actual image expansion exceeds the resolution in the sub-scanning direction. In concrete terms, the unit dot diameter in the sub-scanning direction is set as given by the following Expression 10.

Size in the sub-scanning direction of a unit dot of the latent image formed on the photosensitive drum 2=(size in the main scanning direction of a unit dot of the latent image corresponding to a toner image having a size which is not expanded/contracted from the original image)−(shift amount×½−resolution in the sub-scanning direction) (Expression 10)

Here the shift amount is determined as follows based on Expression 10.

Shift amount=(resolution in the sub-scanning direction+the size in the main scanning direction of the unit dot of the latent image corresponding to the toner image having the size which is not expanded/contracted from the original image−the size in the sub-scanning direction of the unit dot of the latent image formed on the photosensitive drum 2)×2 (Expression 11)

As a result, the upper limit value of the shift amount can be increased, for example, to double the resolution in the sub-scanning direction+20 μm, if the unit dot diameter in the sub-scanning direction is set to be smaller than the diameter in the main scanning direction by 10 μm. Further, the upper limit value can be increased to double the resolution in the sub-scanning direction+30 μm, if the unit dot diameter in the sub-scanning direction is set to be smaller than the diameter in the main scanning direction by 15 μm.

Thereby the upper limit value of the shift amount can be at least double the resolution in the sub-scanning direction.

A method for setting the upper limit value of the shift amount to at least 30 μm will be described next.

In this case as well, based on the same concept, the unit dot diameter in the sub-scanning direction is decreased so that the net image expansion amount becomes 15 μm or less. In other words, the shift amount is set so that the following Expression 12 is established.

Size in the sub-scanning direction of the unit dot of the latent image formed on the photosensitive drum 2=size in the main scanning direction of the unit dot of the latent image corresponding to the toner image having a size which is not expanded/contracted from the original image−(shift amount×½−15 μm) (Expression 12)

Here the shift amount is determined as follows based on Expression 12.

Shift amount=30 μm+(size in the main scanning direction of the unit dot of the latent image corresponding to the toner image having the size which is not expanded/contracted from the original image−the size in the sub-scanning direction of the unit dot of the latent image formed on the photosensitive drum 2)×2 (Expression 13)

As a result, the upper limit value of the shift amount can be increased to 50 μm, if the unit dot diameter in the sub-scanning direction is set to be smaller than the diameter in the main scanning direction by 10 μm, and to 60 μm if the unit dot diameter in the sub-scanning direction is set to be smaller than the diameter in the main scanning direction by 15 μm.

By using the above mentioned method, the upper limit value of the shift amount can be at least 30 μm. Even if the unit dot diameter in the sub-scanning direction is decreased in advance, and the upper limit value of the shift amount is increased as described in this embodiment, the net image expansion amount with respect to the original image is the same as Embodiment 3. Therefore the character quality can also be maintained at a level equivalent to Embodiment 3.

In other words, even if a large shift amount is required to obtain a desired transferability, the shift amount can be increased without diminishing the character quality by adjusting the aspect ratio of the unit dot to an appropriate value, which is an effect unique to this embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-041699 filed on Mar. 6, 2017, and No. 2017-249817 filed on Dec. 26, 2017, which are hereby incorporated by reference herein in their entirety.

What is claimed is:

1. An image forming apparatus, comprising:

an image bearing member;

an intermediate transfer belt onto which a toner image, formed on the image bearing member, is transferred;

a contact member that contacts a surface of the intermediate transfer belt on a side opposite to the image bearing member and forms a transfer nip portion where the intermediate transfer belt and the image bearing member come into contact with each other; and a control unit for controlling a peripheral velocity difference between a peripheral velocity of the intermediate transfer belt and a peripheral velocity of the image bearing member, wherein when a relative moving distance between the image bearing member and the intermediate transfer belt, which is generated in the transfer nip portion due to the peripheral velocity difference, is taken as a shift amount of the toner image, the control unit sets a lower limit value of the shift amount to be at least ⅜ of an average perimeter calculated from a weight-average particle diameter of the toner, which is measured in advance.

2. The image forming apparatus according to claim 1, wherein the lower limit value of the shift amount is a value determined so that the reflection density of a residual toner image, which remains on the image bearing member after the transfer to the intermediate transfer belt, becomes lower than a predetermined threshold.

3. The image forming apparatus according to claim 1, wherein an upper limit value of the shift amount is set so as to be not greater than double the resolution of the toner image in a moving direction of the image bearing member.

4. The image forming apparatus according to claim 1, further comprising an exposing unit that forms a latent image by exposing the image bearing member, wherein an upper limit value of the shift amount is the resolution of the toner image in a moving direction of the image bearing member×2+(the size in the main scanning direction of a unit dot of the latent image formed on the surface of the image bearing member, which is the surface exposed by the exposing unit−the size in the sub-scanning direction of the unit dot of the latent image formed on the surface of the image bearing member, which is the surface exposed by the exposing unit)×2.

5. The image forming apparatus according to claim 1, wherein an upper limit value of the shift amount is a value resulting from an evaluation experiment performed in advance, in which the expansion of the toner image is visually recognized.

6. The image forming apparatus according to claim 1, wherein an upper limit value of the shift amount is 30 μm.

7. The image forming apparatus according to claim 1, further comprising an exposing unit that forms a latent image by exposing the image bearing member, wherein an upper limit value of the shift amount is 30 μm+(the size in the main scanning direction of a unit dot of the latent image formed on the surface of the image bearing member, which is the surface exposed by the exposing unit−the size in the sub-scanning direction of the unit dot of the latent image formed on the surface of the image bearing member, which is the surface exposed by the exposing unit)×2.

8. The image forming apparatus according to claim 1, wherein the control unit controls the peripheral velocity difference by controlling the rotation of each driving source of a driving system configured to drive the image bearing member and the intermediate transfer belt.

9. The image forming apparatus according to claim 1, wherein the control unit controls the peripheral velocity difference by changing a velocity transmission ratio from a common driving source to the image bearing member and the intermediate transfer belt.

10. The image forming apparatus according to claim 1, wherein the contact member is a transfer member configured to transfer the toner image from the image bearing member to the intermediate transfer belt, and the transfer member is disposed so as to face the image bearing member via the intermediate transfer belt.

11. The image forming apparatus according to claim 10, wherein the transfer member is a roller including an elastic body.

12. The image forming apparatus according to claim 1, wherein the contact member is a transfer member configured to transfer the toner image from the image bearing member to the intermediate transfer belt, and the transfer member is disposed in a position that is distant from the image bearing member at an upstream side or a downstream side.

13. The image forming apparatus according to claim 12, wherein the transfer member is a metal roller.

* * * * *